US006599183B1

(12) United States Patent
Barber

(10) Patent No.: US 6,599,183 B1
(45) Date of Patent: Jul. 29, 2003

(54) SHUTTER ASSEMBLY FOR AN INTAKE OPENING IN AN EXHAUST FAN

(76) Inventor: Gary A. Barber, 5676 N. Dearborn Rd., Guilford, IN (US) 47022

( * ) Notice: Subject to any disclaimer, the term of this patent is extended or adjusted under 35 U.S.C. 154(b) by 0 days.

(21) Appl. No.: 09/822,144

(22) Filed: Mar. 30, 2001

(51) Int. Cl.[7] ..... F24F 13/20

(52) U.S. Cl. ..... 454/353; 49/395; 49/475.1; 292/194

(58) Field of Search ..... 49/381, 394, 395, 49/402, 475.1; 454/341, 347, 349, 350, 353, 358, 359; 292/194, 240

(56) References Cited

U.S. PATENT DOCUMENTS

| | | | | | |
|---|---|---|---|---|---|
| 1,930,760 | A | * | 10/1933 | Leland | 454/343 |
| 2,631,519 | A | | 3/1953 | Sprouse et al. | |
| 3,651,750 | A | | 3/1972 | Field | |
| 4,179,144 | A | * | 12/1979 | Henderson | 292/202 |
| 4,372,196 | A | | 2/1983 | Henderson | |
| 4,385,552 | A | | 5/1983 | Nabben | |
| 4,406,216 | A | | 9/1983 | Hott et al. | |
| 4,483,102 | A | * | 11/1984 | Edwards | 454/259 |
| D281,273 | S | | 11/1985 | Artwick | |
| 4,922,660 | A | * | 5/1990 | Omelchuk | 34/242 |
| 5,711,706 | A | * | 1/1998 | Griffin et al. | 454/338 |
| 5,887,916 | A | * | 3/1999 | Finkelstein et al. | 292/202 |

* cited by examiner

*Primary Examiner*—Harold Joyce

(57) ABSTRACT

A shutter assembly for an intake opening in an exhaust fan for improving heating and cooling efficiency of a structure by preventing air in the structure from flowing through the exhaust fan and out of the structure. The shutter assembly for an intake opening in an exhaust fan includes a door for selectively positioning over an air intake opening in an exhaust fan. The door is mountable on the surface round the exhaust fan by at least one hinge member. The hinge member may be mounted on the door for pivotally coupling the door to the surface around the exhaust fan such that the door is pivotable between an open position and a closed position. A locking assembly is mounted on the surface and releasably couplable to the door for selectively securing the door in the closed position.

1 Claim, 6 Drawing Sheets

SHUTTER ASSEMBLY FOR AN INTAKE OPENING IN AN EXHAUST FAN

BACKGROUND OF THE INVENTION

1. Field of the Invention

The present invention relates to shutters and more particularly pertains to a new shutter assembly for an intake opening in an exhaust fan for improving heating and cooling efficiency of a structure by selectively preventing air in the structure from flowing through the exhaust fan and out of the structure when the fan is not being operated.

2. Description of the Prior Art

The use of shutters is known in the prior art. More specifically, shutters heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,631,519; U.S. Pat. No. 4,385,552; U.S. Pat. No. 4,406,216; U.S. Pat. No. 4,372,196; U.S. Pat. No. Des. 281,273; and U.S. Pat. No. 3,651,750.

While these devices fulfill their respective, particular objectives and requirements, the aforementioned patents do not disclose a new shutter assembly for an intake opening in an exhaust fan. The inventive device includes a door for selectively closing an air intake opening in an exhaust fan. The door is mountable on the surface around the exhaust fan by at least one hinge member. The hinge member may be mounted on the door for pivotally coupling the door to the surface around the exhaust fan such that the door is pivotable between an open position and a closed position. A locking assembly is mounted on the surface and releasably couplable to the door for selectively securing the door in the closed position.

In these respects, the shutter assembly for an intake opening in an exhaust fan according, to the present invention substantially departs from the conventional concepts and designs of the prior art, and in so doing provides an apparatus primarily developed for the purpose of improving heating and cooling efficiency of a structure by preventing air in the structure from flowing through the exhaust fan and out of the structure.

SUMMARY OF THE INVENTION

In view of the foregoing disadvantages inherent in the known types of shutters now present in the prior art, the present invention provides a new shutter assembly for an intake opening in an exhaust fan construction wherein the same can be utilized for improving heating and cooling efficiency of a structure by preventing air in the structure from flowing through the exhaust fan and out of the structure.

The general purpose of the present invention, which will be described subsequently in greater detail, is to provide a new shutter assembly for an intake opening in an exhaust fan apparatus and method which has many of the advantages of the shutters mentioned heretofore and many novel features that result in a new shutter assembly for an intake opening in an exhaust fan which is not anticipated, rendered obvious, suggested, or even implied by any of the prior art shutters, either alone or in any combination thereof.

To attain this, the present invention generally comprises a door for selectively closing an air intake opening in an exhaust fan. The door is mountable on the surface around the exhaust fan by at least one hinge member. The hinge member may be mounted on the door for pivotally coupling the door to the surface around the exhaust fan such that the door is pivotable between an open position and a closed position. A locking assembly is mounted on the surface and releasably couplable to the door for selectively securing the door in the closed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it-is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, up on which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shutter assembly for an intake opening in an exhaust fan apparatus and method which has many of the advantages of the shutters mentioned heretofore and many novel features that result in a new shutter assembly for an intake opening in an exhaust fan which is not anticipated, rendered obvious, suggested, or even implied by any of the prior art shutters, either alone or in any combination thereof.

It is another object of the present invention to provide a new shutter assembly for an intake opening in an exhaust fan which may be easily and efficiently manufactured and marketed.

It is a further object of the present invention to provide a new shutter assembly for an intake opening in an exhaust fan which is of a durable and reliable construction.

An even further object of the present invention is to provide a new shutter assembly for an intake opening in an exhaust fan which is susceptible of a low cost of manufacture with regard to both materials and labor, and which accordingly is then susceptible of low prices of sale to the consuming public, thereby making such shutter assembly for an intake opening in an exhaust fan economically available to the buying public.

Still yet another object of the present invention is to provide a new shutter assembly for an intake opening in an exhaust fan which provides in the apparatuses and methods of the prior art some of the advantages thereof, while simultaneously overcoming some of the disadvantages normally associated therewith.

Still another object of the present invention is to provide a new shutter assembly for an intake opening in an exhaust fan for improving heating and cooling efficiency of a structure by preventing air in the structure from flowing through the exhaust fan and out of the structure.

Yet another object of the present invention is to provide a new shutter assembly for an intake opening in an exhaust fan which includes a door for selectively closing an air intake opening in an exhaust fan. The door is mountable on the surface around the exhaust fan by at least one hinge member. The hinge member may be mounted on the door for pivotally coupling the door to the surface around the exhaust fan such that the door is pivotable between an open position and a closed position. A locking assembly is mounted on the surface and releasably couplable to the door for selectively securing the door in the closed position.

Still yet another object of the present invention is to provide a new shutter assembly for an intake opening in an exhaust fan that saves the owner of a structure money by reducing the cost of heating and cooling a structure. The new shutter assembly save an owner of a structure money by preventing warm or cool air from escaping through an uncovered exhaust fan.

Even still another object of the present invention is to provide a new shutter assembly for an intake opening in an exhaust fan that may be employed in homes and in industrial buildings having exhaust fans.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
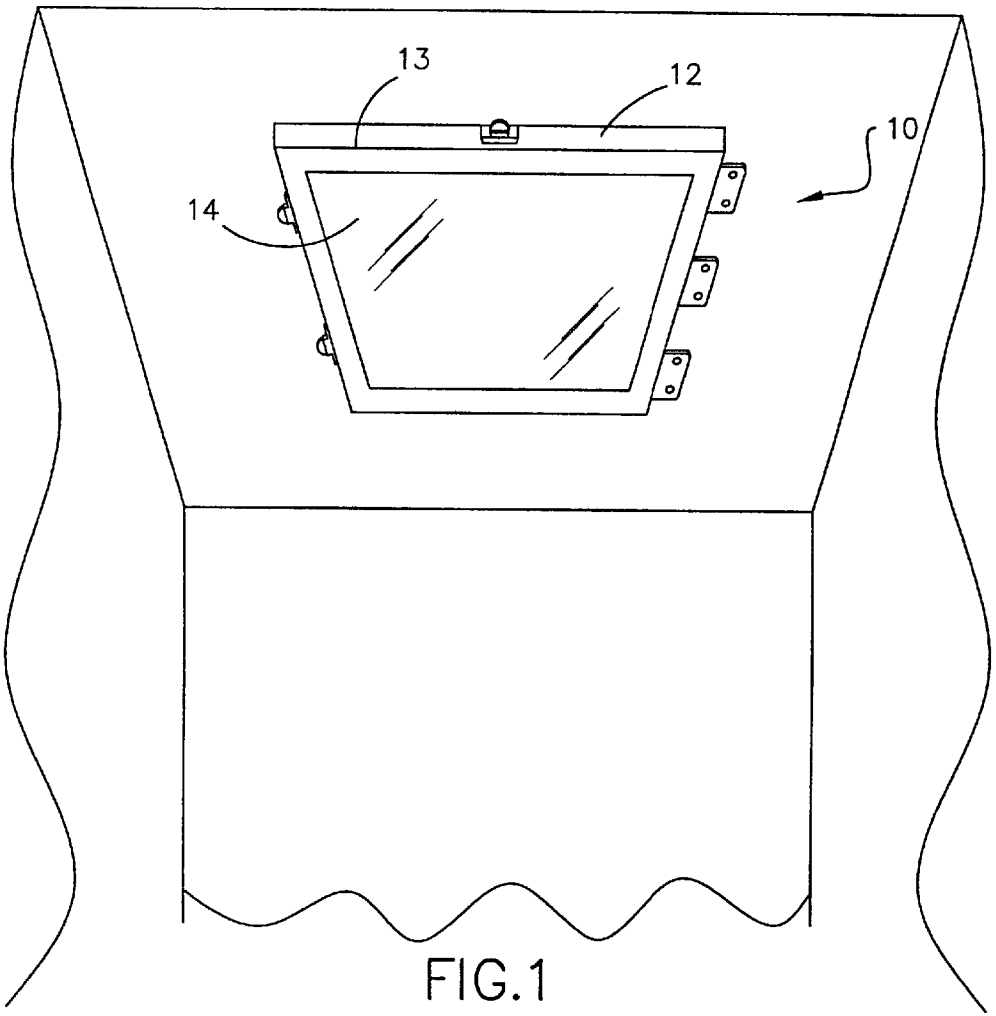
FIG. 1 is a schematic perspective view of a shutter assembly for an intake opening in an exhaust fan according to the present invention showing a door over an exhaust fan.

With reference now to the drawings, and in particular to FIGS. 1 through 8 thereof, a new shutter assembly for an intake opening in an exhaust fan embodying the principles and concepts of the present invention and generally designated by the reference numeral 10 will be described.

Figure 2:
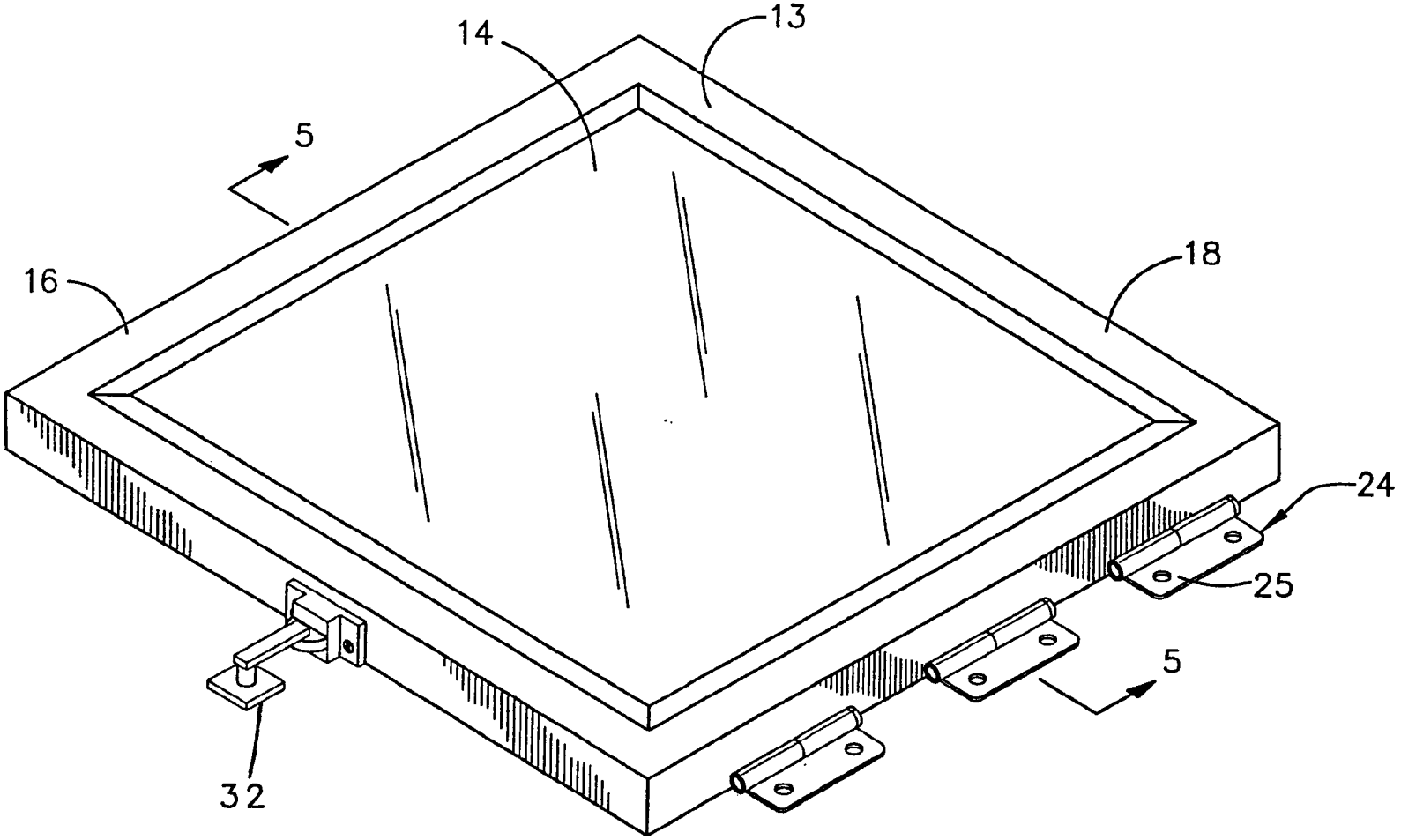
FIG. 2 is a schematic perspective view of the present invention showing the door.
Figure 3:
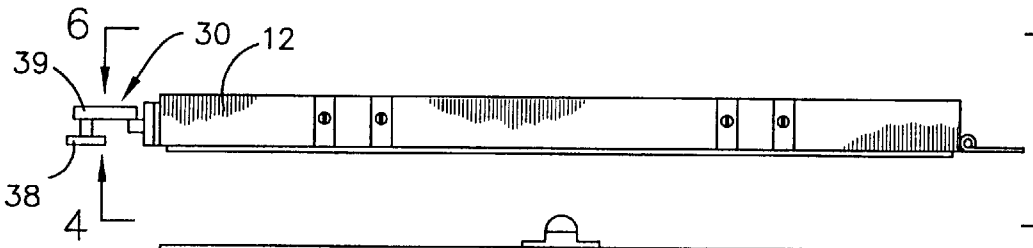
FIG. 3 is a schematic frontal view of the present invention showing a locking assembly for securing the door in a closed position with respect to the exhaust fan.
Figure 4:
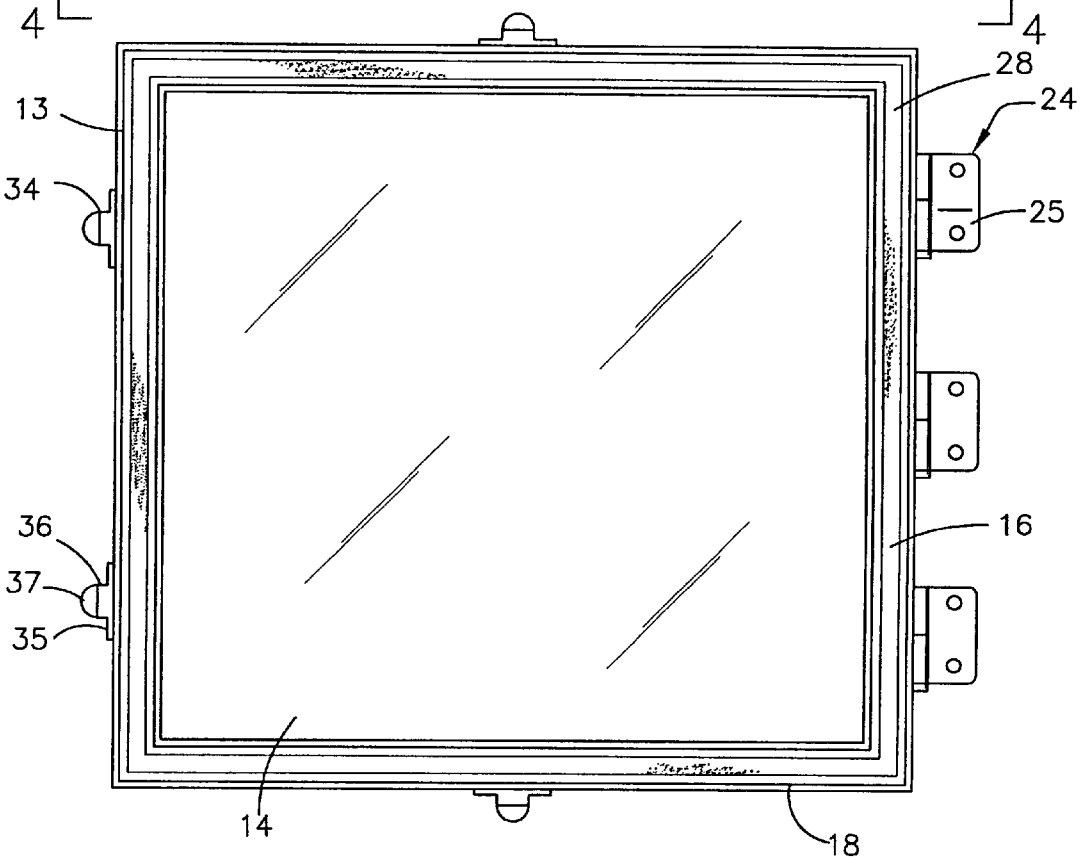
FIG. 4 is a schematic frontal view of the present invention showing a gasket mounted on the door.
Figure 5:
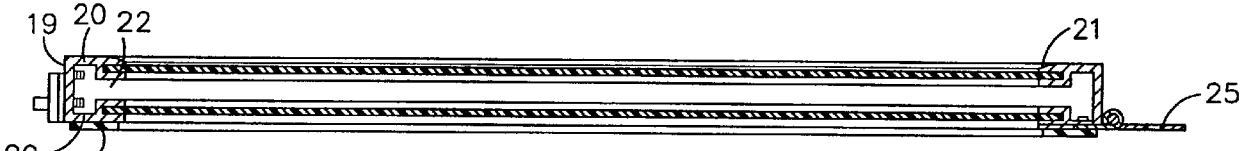
FIG. 5 is a schematic cross-sectional view of the present invention taken along line 5—5 of FIG. 2.

As best illustrated in FIGS. 1 through 8, the shutter assembly 10 for an intake opening in an exhaust fan generally comprises at least one door 12 for selectively closing the air intake opening in an exhaust fan used for providing ventilation to a structure. The exhaust fan may be mounted in a side wall or a ceiling of the structure in order to move air through the structure. As illustrated in FIGS. 1 and 2, the door 12 may comprise a frame portion 13 for mounting on the surface around the exhaust fan and at least one panel portion 14 for preventing air flow from the air intake opening through the frame portion 13. As illustrated in FIG. 5, the door 12 may comprise a pair of panel portions 14.

Figure 6:
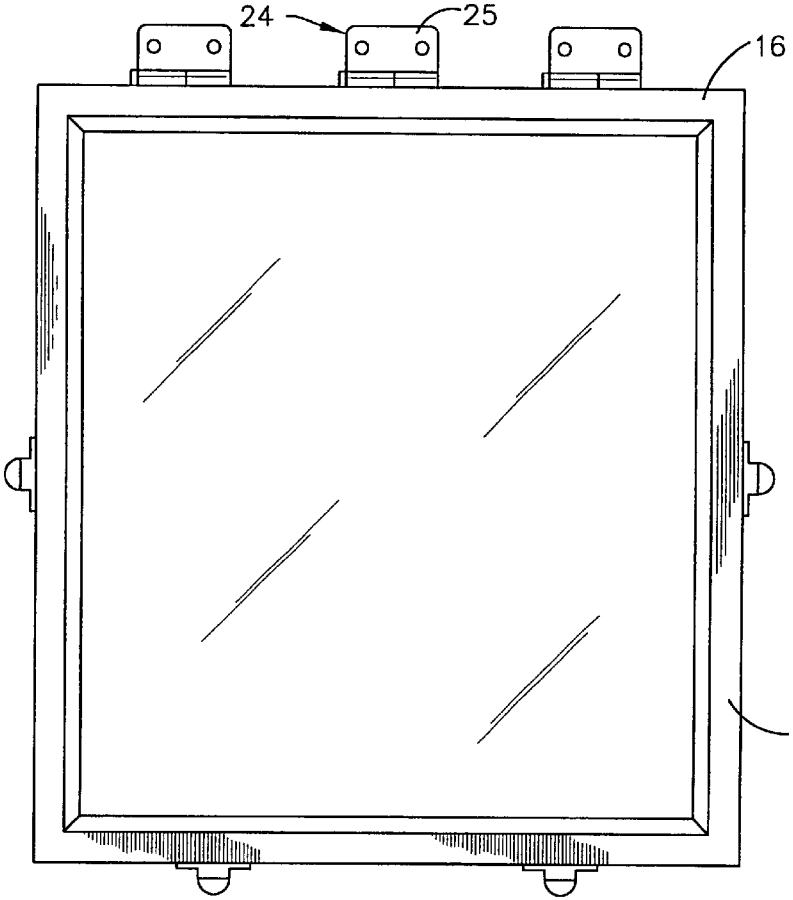
FIG. 6 is a schematic frontal view of the present invention.

In one embodiment of the present invention, as particularly illustrated in FIGS. 2, 4 and 6, the frame portion 13 may have a first pair of elongated members 16 orientated generally parallel to each other and a second pair of elongated members 18 coupled to and extending between each of the first elongated members 16. As illustrated in FIG. 5, each of the elongated members 16 and 18 may include a base wall 19 and a pair of side walls 20 extending from the base wall 16. An edge 21 of each of the side walls 20 defines an opening 22 into each of the elongated members 16 and 18. The frame portion 13 may have a generally rectangular shape, however, other shapes, such as for example, circular shapes may be employed.

In an embodiment of the present invention having a pair of panel portions 14, as illustrated in FIG. 5, each of the panel portions 14 is mounted on one of the side walls 20 of each of the elongated members 16 and 18. The pair of panel portions 14 may be orientated generally parallel to each other such that a three-eighths inch gap extends between each of the panel portions 14. Each of the panel portions 14 may comprise a generally transparent or opaque material.

Various embodiments of the present invention may be employed to connect the door 12 to the surface around the exhaust fan. In one embodiment of the present invention, as particularly illustrated in FIG. 1 through 6, a plurality of hinge members 24 may be provided for pivotally coupling the frame portion 13 of the door 12 to the surface around the exhaust fan. The hinge members 24 may comprise a split hinge or a two piece hinge.

In an embodiment of the present invention having hinge members 24, the door 12 is pivotable between an open position and a closed position. The closed position is characterized by each of the panel portions 14 selectively closing the air intake opening of the exhaust fan. The open position is characterized by each of the panel portions 14 being orientated generally perpendicular to the surface around the exhaust fan such that air may flow through the air intake of the exhaust fan. Each of the hinge members 24 may be mounted on a one of the first pair of elongated members 16. A plate portion 25 of each of the hinge members 24 is mountable to the surface around the exhaust fan.

A gasket 28 may be provided for restricting air flowing between the surface around the exhaust fan and each of the elongated members 16 and 18. The gasket 28 is preferably mounted on a first 29 of the side walls of each of the elongated members and extending around a perimeter of the frame portion 13. The gasket 28 is selectively abuttable against the surface when the frame portion 13 is in the closed position; A cross-section of the gasket 28 may measure approximately one-half in thick and one-half in wide. The gasket 28 may comprise a resiliently flexible material such as, for example, a foam or rubber material.

A locking assembly 30 is provided for selectively securing the frame portion 13 of the door 12 in the closed position. The locking assembly 30 may comprise a hook member 32 and a latch member 34 that is releasably engagable to each other. In one embodiment of the present invention, as particularly illustrated in FIG. 4 the latch member 34 has a housing 35 mounted on the base wall 19 of each of the second pair of elongated members 18 and on one the first elongated members 16 opposite each of the hinge members 24. An end 36 of the housing 35 includes a tab portion 37 formed thereon.

As illustrated in FIG. 3, the hook member 32 may have a mounting plate portion 38 and a hook portion 39 pivotally coupled together. The mounting plate portion 38 is mountable to the surface around the exhaust fan and positioned generally adjacent one of the latch members 34 when the frame portion 13 in the closed position. The hook portion 39 is pivotally positioned over the tab portion 37 such that the hook portion 39 selectively engages the tab portion 37 securing the frame portion 13 in the closed position. The locking assembly 30 may comprise a cam lock mounted on the door that is selectively engagable with the surface around the exhaust fan or the exhaust fan itself. Other types of locking assemblies may be employed.

Figure 7:
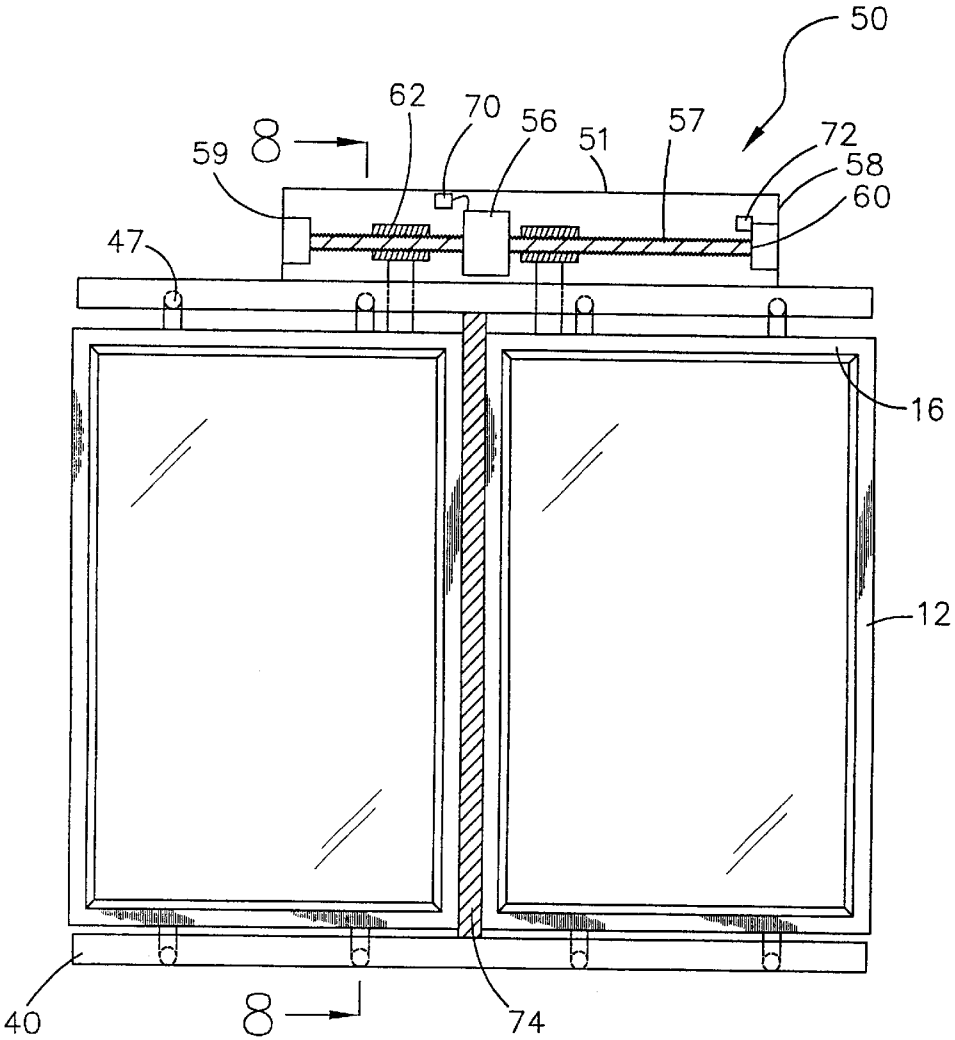
FIG. 7 is a schematic frontal view of another embodiment of the present invention having a pair of doors.
Figure 8:
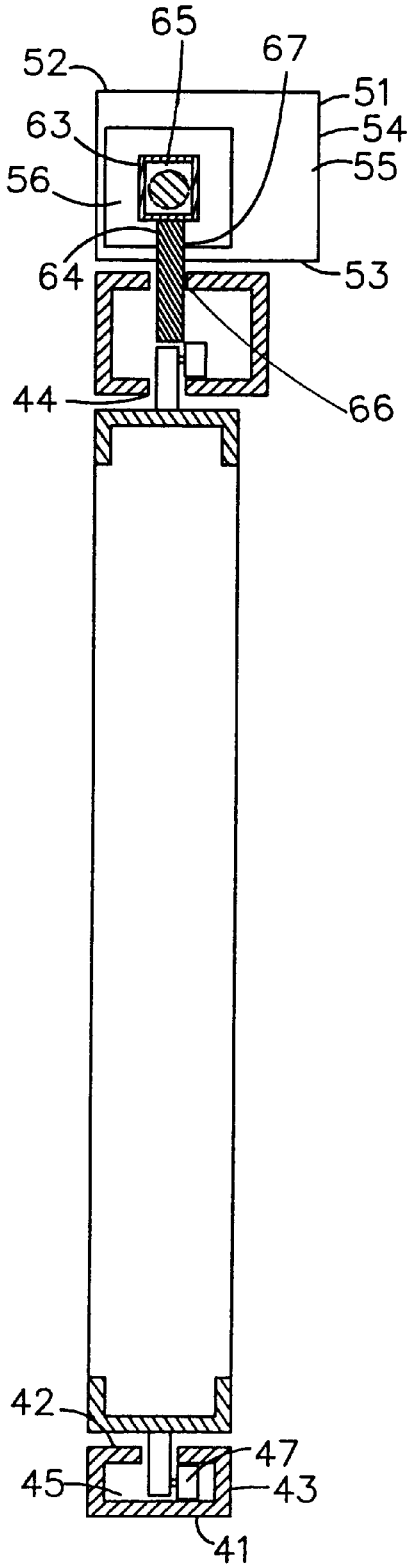
FIG. 8 is a schematic cross-sectional view of the present invention taken along, line 8—8 of FIG. 7 showing the doors mounted in a pair of tracks.

In another embodiment of the present invention, as illustrated in FIG. 7, a pair of doors 12 may be provided for selectively closing the air intake opening in the exhaust fan. Instead of pivotally closing the opening in the exhaust fan, a pair of tracks 40 may be provided for slidably mounting each of the doors 12 to the surface around the exhaust fan. Each of the tracks 40 may include a bottom wall 41, a top wall 42 and a pair of lateral walls 43 extending between the bottom 41 and top 42 walls. An elongated opening 44 extends into the top wall 42.of each of the tracks 40. The opening is in communication with a channel 45 of each of the tracks 40. A first of the lateral walls 43 of each of the tracks 40 is mountable to the surface around the exhaust fan such that each of the channels 45 faces each other. Each of the first pair of elongated members 16 is slidably mounted in one of the channels 45.

Each of the doors 12 is positionable between an open position and a closed position. In one embodiment of the present invention, the closed position is characterized by the doors selectively 12 abutting each other and selectively closing the air intake opening in the exhaust fan. The open position is characterized by each of the doors 12 being positioned generally adjacent to the air intake opening of the exhaust fans such that air may flow through the air intake in the exhaust fan.

A plurality of wheels 47 may be provided for moving each of the doors 12 in each of the tracks 40. Each of the wheels 47 may be mounted on the base wall 19 of the first pair of elongated members 16 and extending away therefrom. Each of the wheels 47 is preferably positioned in one of the channels 45 of the tracks 40 for guiding the doors 12 between the open and closed position.

A positioning assembly 50 may be provided for selectively positioning the doors 12 between the open and closed positions. The positioning assembly 50 may include a housing 51 that has a top wall 52 and a bottom wall 53. A perimeter wall 54 may extend between the top and bottom walls defining an interior 55 of the housing 51.

A motor 56 is provided for slidably moving each of the doors 12 in the pair of tracks 40. The motor 56 may be mounted in the interior 55 of the housing 51. The motor 56 may include a pair of drive shafts 57 mounted thereon. Each of the drive shafts 57 extends longitudinally toward and rotatably mounted to opposite ends 58 of the housing 51. The frame portion 13 of each of the doors 12 is operationally coupled to one of the drive shafts 57. Each of the drive shafts 57 may have a threaded exterior surface.

A pair of bearings 59 may be provided for rotatably mounting each of the drive shafts 57 to the housing 51. Each of the bearings 59 is preferably mounted on the housing 51 and operationally coupled to an end 60 of one of the drive shafts 57.

A pair of brackets 62 may be provided for selectively coupling the frame portion 13 of each of the doors 12 to one of the drive shafts 57. Each of the brackets 62 may include a sleeve portion 63 and a connecting portion 64 coupled together. In one embodiment of the present invention, an interior 65 of the sleeve portion 63 is threadedly coupled to the drive shaft 57.

The connecting portion 64 may be mounted on the base wall 19 of one of the first pair of elongated members 16. The connecting portion 64 preferably extends through the opening 44 of one of the tracks 40 and through the channel,45 of the track 40. The connecting portion 64 extends through an elongated slot 66 of the track 40 that is axially aligned with the opening 44 of the track 40. An end 67 of the connecting portion 64 is preferably mounted on the sleeve portion 63.

A first switch 70 may be provided for causing movement of the doors 12 between the closed position and the open position. The first switch 70 may be mounted in the housing 51 and electrically connected to the motor 56. A second switch 72 may be mounted in the housing 51 and electrically connectable to a motor of the exhaust fan. In one embodiment of the present invention, the second switch 72 selectively provides power to the motor of the exhaust fan when the pair of doors 12 is in the open position. The second switch 72 is preferably mounted in the housing 51 such that it is activated when the doors 12 are in the open position.

A pair of gaskets 74 may be provided for restricting air flowing between the pair of doors 12. Each of the gaskets 74 is mounted oil a first of the second pair of elongated members 18 and preferably extends a length of doors 12. Each of the gaskets 74 is selectively abuttable against each other when the pair of doors 12 are in the closed position. Each of the gaskets 74 may comprise a generally flexible material.

In use, the doors 12 are placed in the open position to allow air the exhaust fan to move air through a structure. The doors 12 are in the closed position to prevent air from escaping through the exhaust fan to an exterior of the structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shutter assembly for regulating air flow through an air intake opening in an exhaust fan, the exhaust fan being mounted on a surface, said assembly comprising:

a door for selectively positioning over the air intake opening in the exhaust fan, said door being mountable on the surface around the exhaust fan;

at least one hinge member mounted on said door for pivotally coupling said door to the surface around the exhaust fan such that said door is pivotable between an open position and a closed position;

a locking assembly mounted on the surface and releasably couplable to said door for selectively securing said door in said closed position;

wherein said locking assembly comprises three subassemblies, each of said subassemblies being mounted on a different side edge of said door, each of said subassemblies comprising a hook member and a latch member being releasably engagable to each other, said hook member being mountable on the surface and said latch member being mounted on said door;

wherein said door comprises a frame portion for mounting on the surface around the exhaust fan and at least one panel portion mounted on said frame portion for preventing air flow from the air intake opening;

wherein said frame portion has a first pair of elongated members and a second pair of elongated members extending between said first elongated members;

wherein said latch member of each subassembly has a housing mounted on one of said side edges of said door, an end of each of said housings having a tab portion formed thereon, said hook member selectively engaging said tab portion; and wherein said hook member has a mounting plate portion and a hook portion pivotally coupled together, said mounting plate portion being mountable to the surface around the exhaust fan, said hook portion being pivotally positioned over said tab portion such that said hook portion selectively engages said tab portion securing said frame in said closed position, said mounting plate portion being positioned a distance away from said tab portion of said housing such that an end of said hook portion selectively engages said tab portion of said housing wherein a plate portion of.said hinge member is mountable to the surface around the exhaust fan;

wherein each of said elongated members has a base wall and a pair of side walls extending from said base wall, said panel portion being mounted on one of said side walls of said elongated members;

wherein a pair of panel portions is mounted on said frame portion, each of said panel portions being mounted on one of said side walls of said elongated members.

* * * * *